US007963062B1

(12) United States Patent
Rothärmel et al.

(10) Patent No.: US 7,963,062 B1
(45) Date of Patent: Jun. 21, 2011

(54) INSERTION MAGAZINE FOR A SMALL ARM

(75) Inventors: Jürgen Rothärmel, Altusried (DE); Christian Scherpf, Obersfeld (DE); Meinrad Zeh, Weitnau (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 932 days.

(21) Appl. No.: 11/680,153

(22) Filed: Feb. 28, 2007

(30) Foreign Application Priority Data

Mar. 3, 2006 (DE) ..... 10 2006 009 895

(51) Int. Cl.
*F41A 11/00* (2006.01)

(52) U.S. Cl. ..... 42/69.01; 42/6

(58) Field of Classification Search ..... 42/6, 7, 42/49.01, 50, 69.02, 69.03, 18, 22
See application file for complete search history.

(56) References Cited

U.S. PATENT DOCUMENTS

| | | | | | |
|---|---|---|---|---|---|
| 527,869 | A * | 10/1894 | Mauser | ..... | 42/50 |
| 667,856 | A * | 2/1901 | Wagner | ..... | 42/50 |
| 840,850 | A * | 1/1907 | Johnson | ..... | 42/18 |
| 1,290,833 | A * | 1/1919 | Hammond | ..... | 42/18 |
| 1,400,252 | A * | 12/1921 | Weed | ..... | 42/18 |
| 2,657,489 | A * | 11/1953 | Robertson, Jr. | ..... | 42/50 |
| 2,997,803 | A * | 8/1961 | Florence | ..... | 42/18 |
| 3,235,994 | A * | 2/1966 | Grippo | ..... | 42/50 |
| 3,803,739 | A * | 4/1974 | Haines et al. | ..... | 42/6 |
| 4,237,638 | A * | 12/1980 | Trexler | ..... | 42/6 |
| 5,519,954 | A * | 5/1996 | Garrett | ..... | 42/6 |
| 5,899,013 | A * | 5/1999 | Hauser et al. | ..... | 42/6 |
| 2005/0262752 | A1 * | 12/2005 | Robinson et al. | ..... | 42/71.01 |

FOREIGN PATENT DOCUMENTS

| | | |
|---|---|---|
| DE | 3136965 | 3/1983 |
| DE | 19538425 | 4/1997 |
| DE | 202004016800 | 10/2005 |
| EP | 0907065 | 4/1999 |
| WO | WO 90/10841 | 9/1990 |

* cited by examiner

*Primary Examiner* — Michael Carone
*Assistant Examiner* — Reginald Tillman, Jr.
(74) *Attorney, Agent, or Firm* — Martin Fleit; Paul D. Bianco; Fleit Gibbons Gutman Bongini & Bianco PL

(57) ABSTRACT

The invention concerns an insertion magazine (2) for a small arm, in particular, a repeating rifle. The insertion magazine (2) is characterized in that a trigger unit (3) with a trigger guard (7) and a trigger (9) is mounted on its underside in such a manner that the trigger unit (3) is removable together with the insertion magazine (2) from the small arm.

20 Claims, 7 Drawing Sheets

INSERTION MAGAZINE FOR A SMALL ARM

CROSS-REFERENCE TO RELATED APPLICATION

This application claims priority under 35 U.S.C. §119 to German Patent Application No. 10 2006 009 895.1 filed Mar. 3, 2006, the entire contents of which are incorporated herein by reference.

FIELD OF THE INVENTION

The invention concerns an insertion magazine of a small arm, especially a repeating rifle, and a small arm with such an insertion magazine.

BACKGROUND OF THE INVENTION

In repeating rifles with a cylinder breech mechanism, the cartridge magazine is, as a rule, located under the breech mechanism. Particularly with repeating rifles with the long type of construction, the magazine is often placed, as an insertion magazine, in a magazine shaft, open downwards, in front of the trigger guard, so that the magazine can also be readily removed downwards. The magazine, however, can be accommodated in a magazine shaft, accessible from the top, above the trigger guard, especially with a shorter type of construction, in which case the magazine is pressed from above into the magazine shaft when the breech mechanism is open. In order to completely unload the weapon with such a magazine arrangement, the cartridges must, however, either be removed from the magazine with one's finger, after opening the breech mechanism, or they must be ejected one by one by opening and closing the breech mechanism. However, this requires a relatively high effort for complete unloading of the weapon, which is a requirement for transporting the weapon inside a vehicle, when getting on or leaving a raised blind, or before entering a building.

From DE 20 2004 016 800 U1, a lock box for a repeating rifle with a magazine shaft for a removable magazine is known. In this known lock box, the underside of the magazine shaft is covered with a plate, which has a pivotable lid that can be locked, which carries a trigger lever and separates the trigger lever from the trigger mechanism in the opened position for the removal or the insertion of the magazine, and in the closed position, couples the trigger lever with the trigger mechanism.

The problem of the invention is to create an insertion magazine for a small arm and a small arm with such an insertion magazine that allows a rapid unloading and loading of the small arm, even if the magazine is located above the trigger guard.

SUMMARY OF THE INVENTION

This problem is solved by an insertion magazine as set forth in the claims and by a small arm as also set forth in the claims.

Appropriate refinements and advantageous embodiments of the invention are the object of the dependent claims.

in the insertion magazine in accordance with the invention, a trigger unit with a trigger guard and trigger are affixed on its underside in such a way that the trigger unit can be removed, together with the insertion magazine, from the small arm. A small arm can thus be rapidly unloaded and loaded with the full magazine capacity, even if the magazine is above the trigger unit. The magazine and the trigger unit form a totality which can be simply removed, can be transported and kept separate from the small arm, but if needed can also be rapidly mounted again. Thus, the small arm can not only be unloaded rapidly and simply, but, for example, after climbing up a raised blind, can also be rapidly reloaded with the entire magazine capacity and a complete firing readiness. In this respect, the insertion magazine, with the trigger unit affixed thereon, need only be inserted, from below, into a corresponding holder of a breech mechanism housing.

In a particularly advantageous embodiment, the insertion magazine has a blocking mechanism coupled with the trigger, for the releasable locking of the insertion magazine in an inserted position on the small arm. The coupling of the blocking mechanism with the trigger makes it possible for the magazine to be locked above the trigger itself even if the blocking element, which is brought into a locking position by a compression spring, jams because of icing, soiling, or the like.

In an advantageous embodiment, the blocking mechanism comprises a blocking element, which is brought to a locking position by means of a compression spring, and a blocking component for connecting the blocking element to the trigger. In a preferred embodiment, the blocking element is constructed as a blocking pin that is brought into a locking position by a compression spring and can be pushed into a retracted release position by an actuation element. Via the blocking component, the blocking element is not only brought into a locking position by the actuation of the trigger, but rather, the trigger is also pressed into a front starting position when the push button is actuated. In this way, the trigger can contact a trigger rod in the breech mechanism housing only after the complete locking of the insertion magazine. Thus, a trigger which is stationary in the pressed position cannot lead to the undesired release of a shot.

The actuation element for the displacement of the blocking element into a release position can be located directly on the trigger guard or also on a breech mechanism housing of the small arm.

In another embodiment, the blocking mechanism can contain two blocking elements, which can be displaced transversely and which are prestressed laterally against the locking crosslinks by a trigger slide bar, impinged on by a spring and coupled with the trigger. Furthermore, the trigger contains a blocking slide bar, which acts together with the two blocking elements and which is guided in such a way that it can be displaced on the bottom of a magazine and, in a prespecified locking position, prevents a pressing-together of the two locking crosslinks and thus an undesired removal of the insertion magazine.

In an advantageous embodiment, the insertion magazine consists of a magazine shaft and a replaceable magazine insert. In this way, the insertion magazine can be simply adapted to different calibers. However, the insertion magazine can also be constructed as one piece.

A small arm in accordance with the invention, a repeating rifle in particular, is characterized in that it contains an insertion magazine with a trigger unit affixed to its underside.

BRIEF DESCRIPTION OF THE DRAWINGS

Other distinctive features and advantages of the invention can be deduced from the following description of a preferred embodiment, with the aid of the drawing. The figures show the following.

DETAILED DESCRIPTION OF THE INVENTION

Figure 1:
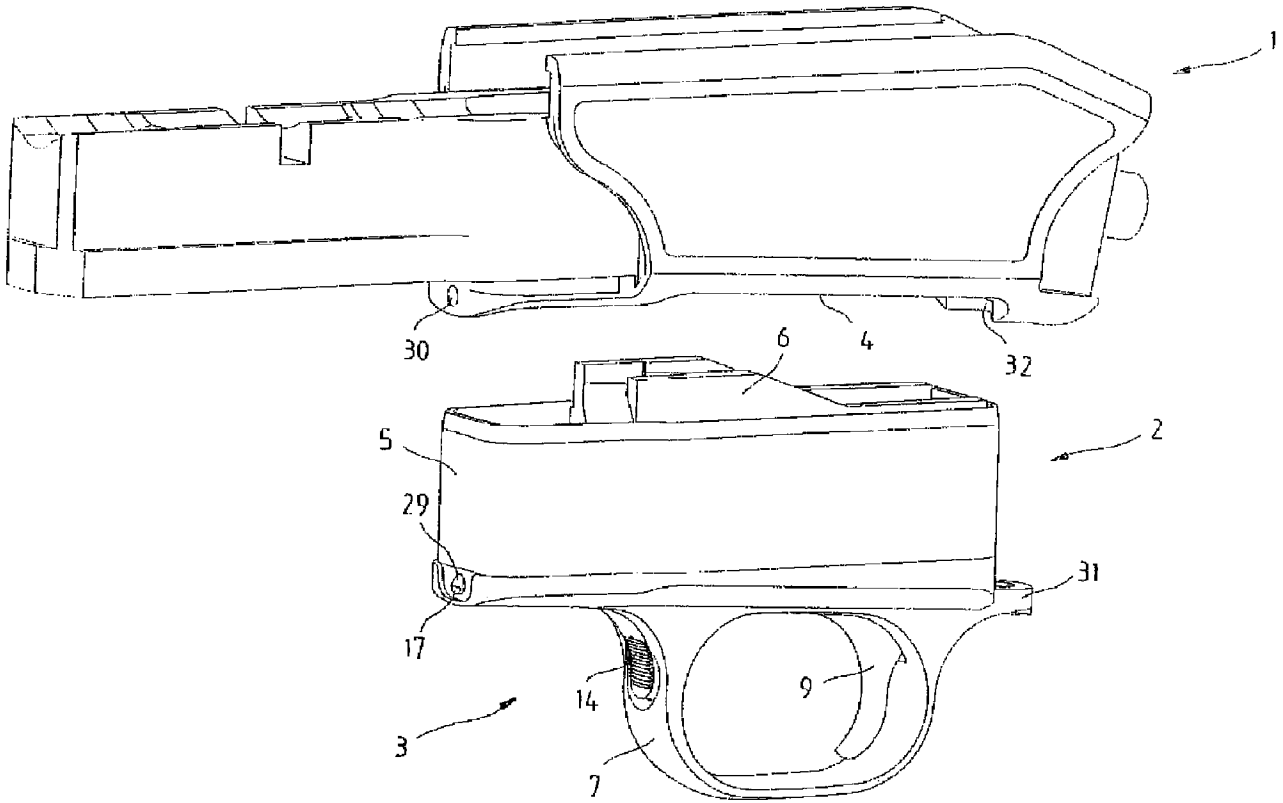
FIG. 1, a breech mechanism housing of a repeating rifle and a corresponding insertion magazine with an integrated trigger unit.

FIG. 1 shows a breech mechanism housing 1 or a system box of a small arm and an insertion magazine 2 with a trigger unit 3 affixed to its underside. The breech mechanism housing 1 contains a holder 4, which is accessible from the underside, into which the insertion magazine 2 is introduced. In a conventional manner, a barrel, a front shaft, and a rear shaft, not shown, are affixed to the breech mechanism housing 1.

Figure 2:
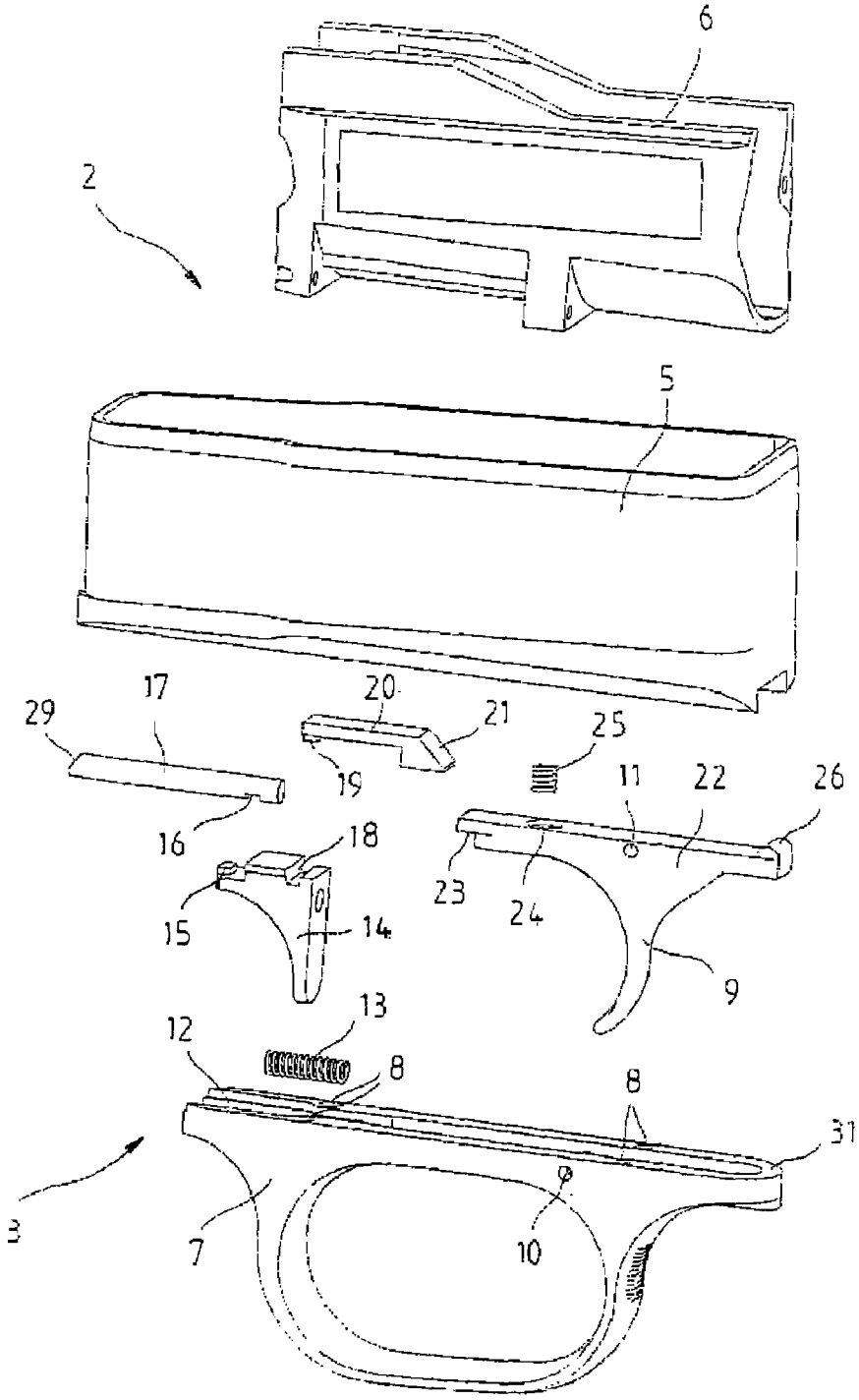
FIG. 2, a first embodiment of an insertion magazine with an integrated trigger unit in an exploded view.
Figure 3:
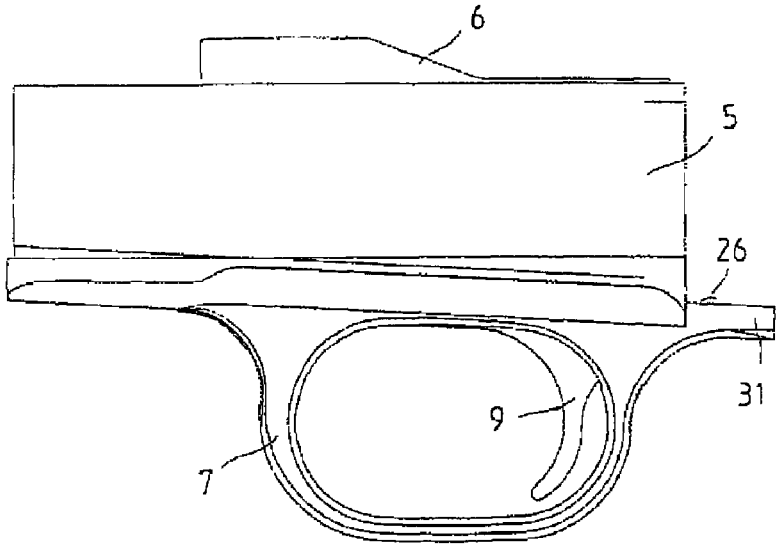
FIG. 3, an insertion magazine with integrated trigger unit in a side view.
Figure 4:
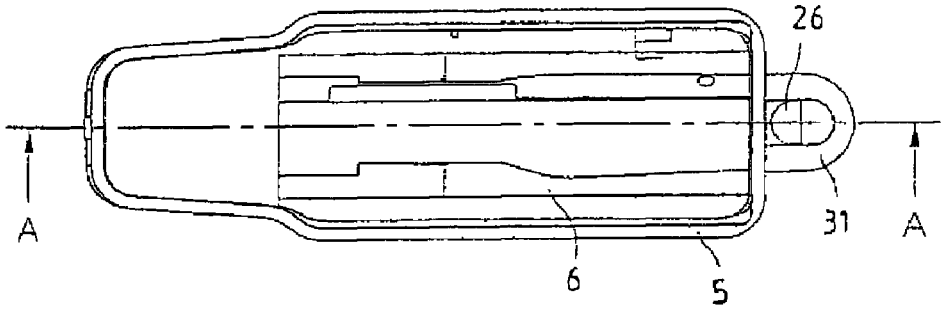
FIG. 4, the insertion magazine of FIG. 3 in a top view.

As can be deduced from FIG. 2 in particular, the insertion magazine 2 comprises a magazine shaft 5 and a magazine insert 6, which is adapted to a desired caliber and when needed, can be simply replaced. A trigger guard 7 of the trigger unit 3 is affixed to the underside of the magazine shaft 5. In this respect, the trigger guard 7 has several threaded boreholes 8 for corresponding screws on its upper side, by means of which the trigger guard 7 is firmly connected with the magazine shaft 5, from the inside of the shaft.

In addition to the trigger guard 7, the trigger unit 3 comprises a trigger 9 situated on the trigger guard 7 in a pivotable manner via boreholes 10 and 11 and a transverse pin, not shown.

On its front side, the trigger guard 7 contains a recess 12, in which an actuation element 14, which is moved forwards by a compression spring 13, is movably guided. The actuation element 14, constructed as a push button or slide bar, has a cam 15, protruding upwards on its front end in the direction of shooting, so as to engage in a lower groove 16 on the rear end of a pin-like blocking element 17. On the rear end of the actuation element 14, an upper groove 18 is provided for the meshing of a carrier 19, protruding downwards, on the front end of a blocking component 20, conducted, in a displaceable manner, in the trigger guard 7. At its rear end, the blocking component 20 contains a bevel 21, which acts together with the trigger 9.

The trigger 9 has, on the front end in the direction of shooting of its trigger blade 22, a step 23 for engaging with the bevel 21 of the blocking component 20. On the upper side of the trigger blade 22, a blind hole 24 for retaining a trigger spring 25 is located between the borehole 11 and the step 23. At the rear end of the trigger blade 22, an upward-protruding cam 26 is provided for engaging with a not-shown trigger rod.

Figure 5:
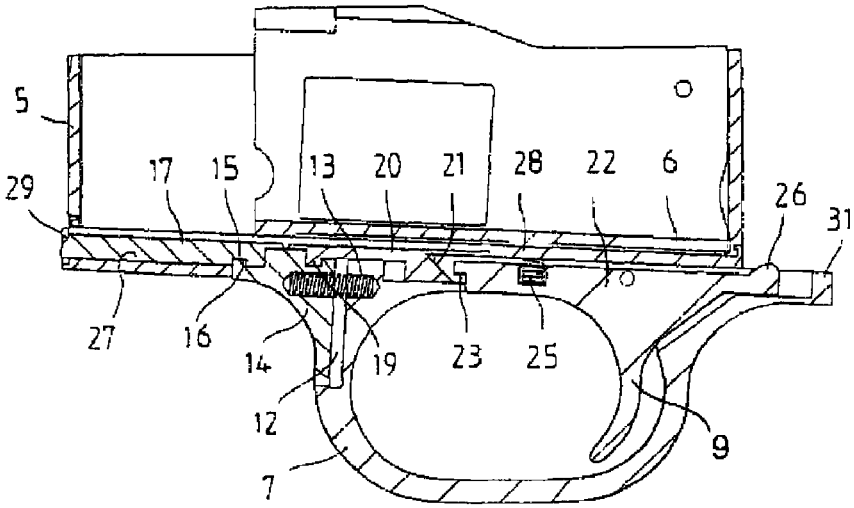
FIG. 5, a side view of the insertion magazine with an integrated trigger unit, along the A-A line of FIG. 4.

From FIG. 5, one can see that the pin-like blocking element 17 is located in a corresponding guide hole 27 of a bottom plate 28 of the magazine shaft 5, in such a manner that it can be displaced axially. At its front end, the pin-like blocking element 17 has an incline 29 and, for locking, engages with its front end in an opening 30 depicted in FIG. 1 on the breech mechanism housing 1. The rear, rounded-off end 31 of the trigger guard 7 protrudes toward the rear relative to the magazine shaft 5, and engages in a recess 32, shown in FIG. 1, on the underside of the breech mechanism housing 1. Via the compression spring 13, which is clamped between the trigger guard 7 and the actuation element 14 according to FIG. 5, the actuation element 14 and the blocking element 17 engaged with it are pressed into a front position that corresponds to the locked position. By displacement of the actuation element 14, the pin-like blocking element 17 is retracted and arrives at the breech mechanism housing 1, without engaging with the opening 30, so that the insertion magazine 2 can be removed, together with the trigger unit 3.

Upon inserting the insertion magazine 2 into the breech mechanism housing 1, the blocking element 17, which is moved forward by the compression spring 13, is first pressed by the bevel 29 and in the correct incorporation position of the insertion magazine 2, engages with its front end in the opening 30 of the breech mechanism housing 1. If the force of the compression spring should not be sufficient because of soiling or icing, for example, then the locking element 17 is displaced forwards when the trigger 9 is actuated by the blocking component 20. This displacement is attained by the bevel 21 which is placed, in the retracted position of the blocking component 20, on the lower step 23 of the trigger blade 22. If the step 23 at the front end of the trigger blade 22 is lowered when the trigger 9 is actuated, the blocking component 20, situated in a retracted position, and with it, the actuation element 14 and the pin-like blocking element 17 are pushed forwards via the bevel 21. This ensures that the insertion magazine 2 is locked before the small arm is actuated.

Another function of the blocking component 20 is the turning of the trigger 9 into its front starting position when the actuation element 14 is actuated. In this way, it is possible for the trigger 9 to be placed with its rear cam 26 on the not-shown trigger rod when the insertion magazine 2 is inserted, only if the insertion magazine 2 is completely locked. Thus, a trigger 9 which is stationary in the pressed position cannot lead to the undesired release of a shot.

Figure 6:
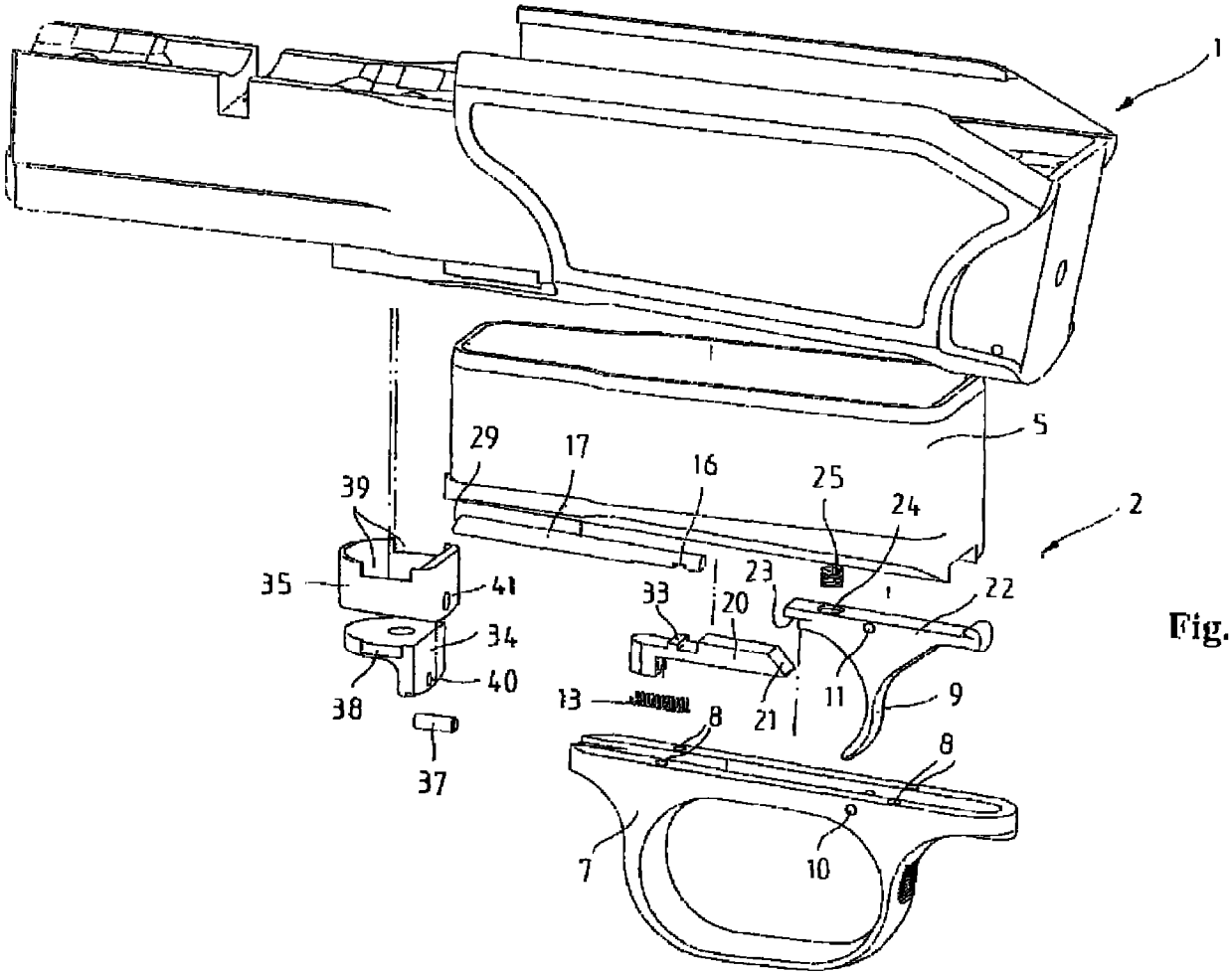
FIG. 6, a second embodiment of an insertion magazine with an integrated trigger unit and a breech mechanism housing in an exploded view.
Figure 7:
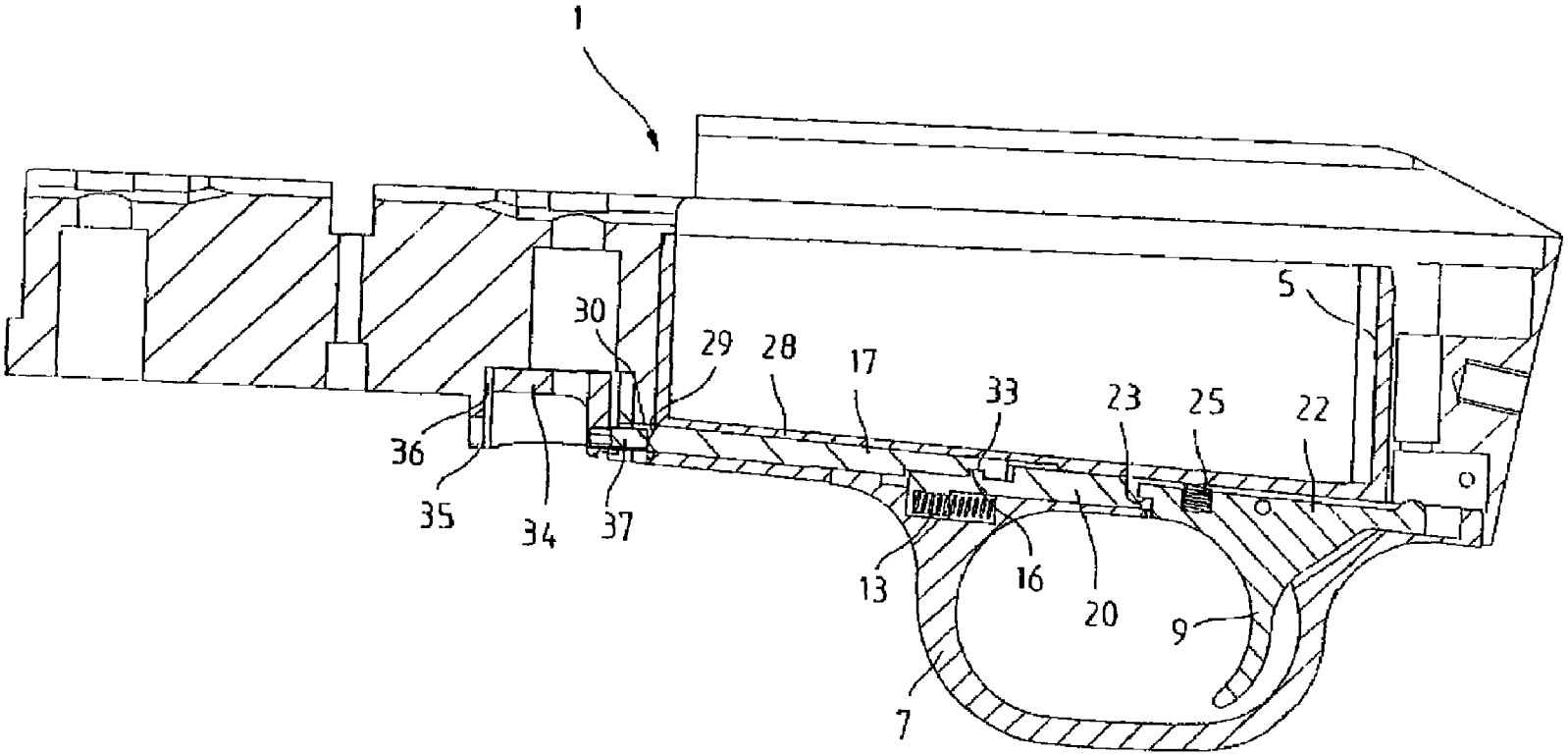
FIG. 7, a sectional view of the breech mechanism housing and insertion magazine of FIG. 6.

FIGS. 6 and 7 show another embodiment of an insertion magazine 2. The basic structure corresponds to the embodiment described in the preceding, so that, parts corresponding to one another are also provided with the same reference symbols. The insertion magazine 2 depicted here also contains a magazine shaft 5, on whose underside a trigger guard 7 is affixed. On its upper side, the trigger guard 7 also has several threaded boreholes 8 for corresponding screws, by means of which the trigger guard 7 is firmly connected to the magazine shaft 5, by the inside of the shaft. In the trigger guard 7, a trigger 9 is situated so that it can rotate, via boreholes 10 and 11 and a nondepicted transverse pin.

Here too, a blocking component 20 is situated in the trigger guard 7 in such a way that it can be displaced. On its rear end, the blocking component 20 also contains a bevel 21, which engages with a step 23 on the front end of a trigger blade 22 of the trigger 9. On the upper side of the trigger blade 22, a blind hole 24 for a trigger spring 25 is also provided. In contrast to the first embodiment, however, the blocking component 20 comprises a peg 33, protruding upwards, which engages in the lower groove 16 on the rear end of the pin-like blocking element 17, which is also conducted here in the bottom plate 28 of the magazine shaft 5, in such a way that it can be displaced. This blocking element 17 also contains a bevel 29 on its front end, and engages, in accordance with FIG. 7, in a corresponding borehole 30 of the breech mechanism housing 1. In contrast to the first embodiment, the compression spring 13 does not engage with an actuation element, but rather directly on the blocking component 20, in order to move the blocking element 17 into a locking position.

In the embodiment shown in FIGS. 5 and 6, the displacement of the pin-like blocking element 17 into its retracted release position takes place by means of an actuation element 34, designed as an angular slide bar, which, in contrast to the first embodiment, is not located in the trigger guard 7, but rather is situated so that, via an insert 35, it can be displaced in a recess 36 on the underside of the breech mechanism housing 1 and is connected with the blocking element 17, via a bolt 37. For the movable guidance, the actuation element 34 has stops 38 protruding outwards on its opposite side surfaces, which stops mesh into corresponding guide grooves 39 on the upper side of the insert 35. The bolt 37 is inserted into a borehole 40 on the rear front side of the slide bar 34 and protrudes toward the rear through an opening 41 of the insert 35.

If the actuation element 34 is pushed to the rear, the blocking element 17 is also pushed back via the bolt 37 and thus releases the insertion magazine 2 for removal, with the entire trigger unit.

Figure 8:
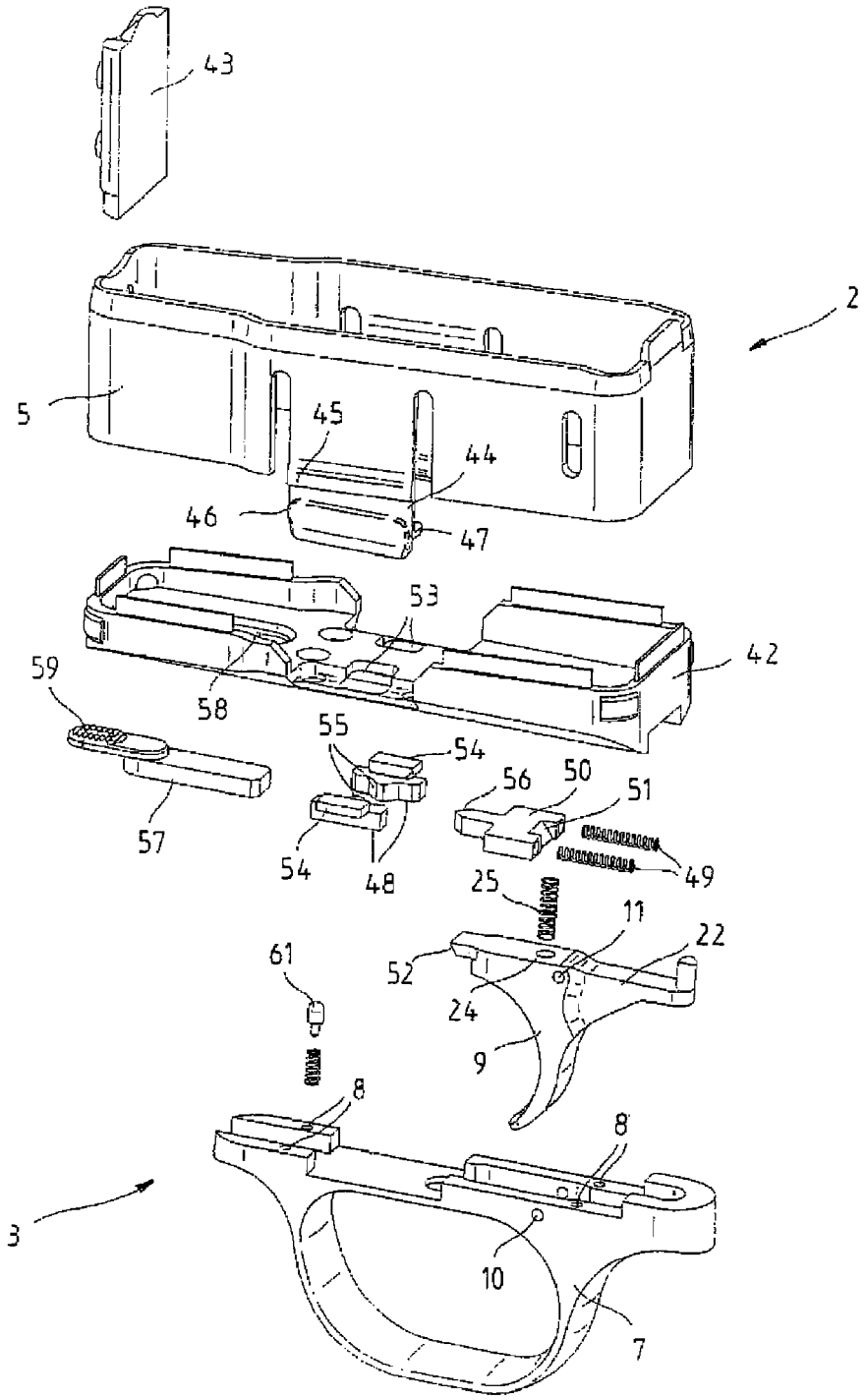
FIG. 8, a third embodiment of an insertion magazine with an integrated trigger unit in an exploded view.
Figure 9:
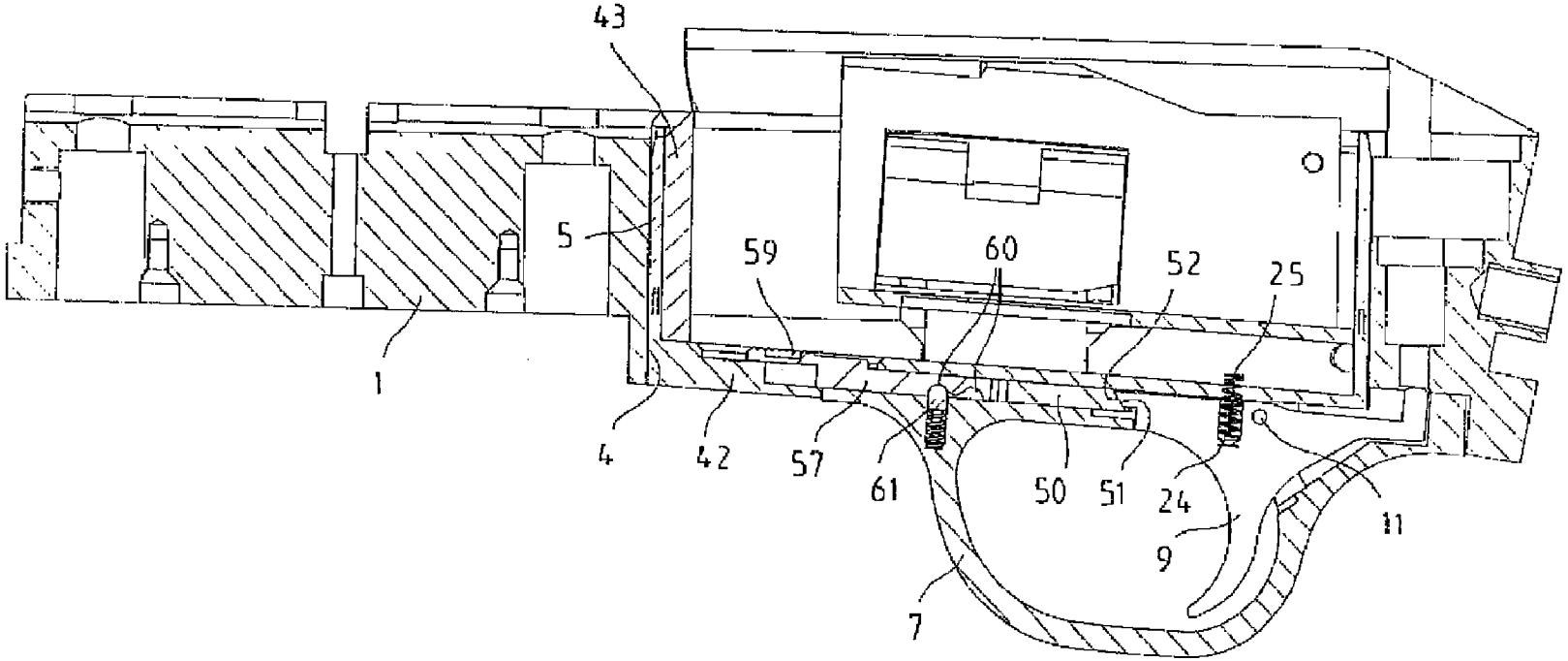
FIG. 9, a sectional view of the breech mechanism housing and insertion magazine of FIG. 8.

Another embodiment of an insertion magazine 2 with an integrated trigger unit 3 is shown in FIGS. 8 and 9. In this embodiment also, the trigger unit 3 comprises a trigger guard 7 and a trigger 9, which is rotatably situated on the trigger guard 7, via boreholes 10 in the trigger guard 7 and boreholes 11 in the trigger 9, and a transverse pin, not shown. Likewise, the trigger 9 has, on the upper side of its trigger blade 22, a blind hole 24, which lies in front of the borehole 11, to hold a trigger spring 25. The insertion magazine 2 also comprises a magazine shaft 5 and a magazine bottom 42, which is constructed here as a separate component and which is inserted together with the magazine shall 5, and is joined firmly to it, by cementing for example. A cartridge buffer 43 is affixed in the interior of the magazine shaft 5, on its front transverse side, viewed in the shooting direction.

The magazine shaft 5, preferably produced from plastic, contains, on its opposite longitudinal sides, laterally-elastic locking crosslinks 44, which protrude downwards, by means of which the insertion magazine 2 is releasably held within a holder 4 of the system box or breech mechanism housing 1, shown in FIG. 9. In this respect, the locking crosslinks 44 comprise wedge-shaped projections 45 on their outside, which engage in corresponding recesses of the breech mechanism housing 1 in the inserted position of the insertion magazine 2, shown in FIG. 9. As one can see from FIG. 8, outside gripping elements 46 and inside supporting shoulders 47 are formed on the lower ends of the locking crosslinks 44, protruding downwards. By pressing the two opposite locking crosslinks 44 on the gripping elements 46 protruding downwards, it is possible to release the lock of the insertion magazine 2 for removal from the corresponding holder 4 of the breech mechanism housing 1.

In the embodiment shown in FIGS. 8 and 9, the insertion magazine 2 also has a blocking mechanism for the releasable locking of the insertion magazine 2 in an inserted position. Here, the blocking mechanism comprises two blocking elements 48, movably situated transverse to the magazine shaft 5 in the magazine bottom 42, which are biased laterally toward the outside against the locking crosslinks 44 by a trigger slide bar 50, which is pushed forwards via springs 49 and coupled with the trigger 9. On its backside, the trigger slide bar 50 has a bevel 51, which acts together with a corresponding counter-bevel 52 on the front end of the trigger 9. The laterally displaceable blocking elements 48 comprise side crosslinks 54, which protrude through recesses 53 in the magazine bottom 42, which are guided on the supporting shoulders 47 on the locking crosslinks 44 of the magazine shaft 5. On the inside, the blocking elements 48 comprise opposite front and rear control bevels 55, which act together with a wedge 56 on the front end of the trigger slide bar 50 in such a way that the two blocking elements 48 are pressed by the forward movement of the trigger slide bar 50 toward the outside, against the locking crosslinks 44.

Furthermore, an additional blocking slide bar 57, which acts together with the two blocking elements 48, is guided in the magazine bottom 42 movably in the longitudinal direction. The blocking slide bar 57 comprises an operating part 59, protruding through an opening 58 of the magazine bottom 42, and can be displaced between the two blocking elements 48 by being pushed back in such a way that they are held pushed outwards in a locking position. In this locking position, pressing together of the two locking crosslinks 44 and thus an undesired removal of the insertion magazine 2 is prevented. Seen in FIG. 9 are two engaging depressions 60, by means of which the blocking slide bar 57, located in the trigger guard 7 and is acted on by a spring, is maintained in its locking position and front release position with the aid of a stop bolt 61, are provided on the underside of the blocking slide bar 57.

As with the two first embodiments, the connection between the trigger 9 and the locking elements 48, produced by means of the trigger slide bar 50 in the embodiment shown in FIGS. 8 and 9 also, ensures that the insertion magazine 2 is locked before the actuation of the small arm. With the actuation of the trigger 9, the trigger slide bar 50 is pushed forwards, via the bevel 51 and the corresponding counter-bevel 52, to press apart the two blocking elements 48 even if the force of the two springs 49 is not sufficient because of soiling or icing.

What is claimed is:

1. An insertion magazine of a small arm, comprising a trigger unit with a trigger guard and a firing trigger, said trigger unit affixed to an underside of the insertion magazine, wherein the trigger unit and the insertion magazine form an interconnected assembly; and wherein the interconnected assembly is readily releasable from the small arm without the use of a tool.

2. The insertion magazine according to claim 1, further comprising a blocking mechanism coupled with the firing trigger, for releasable locking of the insertion magazine in an inserted position on the small arm.

3. The insertion magazine according to claim 2, wherein the blocking mechanism comprises a blocking element, brought to a locking position by means of a compression spring, and a blocking component to connect the blocking element to the firing trigger.

4. The insertion magazine according to claim 3, wherein the blocking component has a rear end, and a bevel on said rear end engages with a step of the firing trigger.

5. The insertion magazine according to claim 3, wherein the blocking element has a front end, and a bevel is disposed on said front end.

6. The insertion magazine according to claim 3, further comprising a magazine shaft having a bottom plate, the blocking element is being situated in such a way that said blocking element is displaceable axially.

7. The insertion magazine according to claim 6, further comprising a replaceable magazine insert being located in the magazine shaft.

8. The insertion magazine according to claim 3, wherein the blocking element is movable into a release position by an actuation element.

9. The insertion magazine according to claim 8, wherein the actuation element is located in a recess of the trigger guard.

10. The insertion magazine according to claim 9, wherein the blocking componen has a front end and a downward-protruding carrier, said downward-protruding carrier being disposed on said front end for engagement in an upper groove at the rear end of the push button.

11. The insertion magazine according to claim 9, wherein the actuation element has a front end, and an upward-protruding cam is disposed on said front end for engagement in a lower groove at the rear end of the blocking element.

12. The insertion magazine according to claim 8, wherein the actuation element is located in a recess of a breech mechanism housing and is connected to the blocking element via a bolt.

13. The insertion magazine according to claim 12, wherein the blocking component has an upward-protruding cam for engagement in a lower groove at the rear end of the blocking element.

14. The insertion magazine according to claim 2, wherein the blocking mechanism comprises a plurality of blocking elements, saidblocking elements being displaceable transversely relative to a magazine shaft, and said blocking elements being biased laterally outwards, against blocking crosslinks, on the magazine shaft by a trigger slide bar, said trigger slide bar being acted on by a spring and is coupled with the firing trigger.

15. The insertion magazine according to claim 14, wherein the plurality of blocking elements includes two blocking elements, and wherein the blocking mechanism comprises a blocking slide bar, cooperating with the two blocking elements, said blocking slide bar being guided movably in a magazine base.

16. A small arm comprising:

a breech mechanism housing having a recess; and an insertion magazine that can be inserted into the recess, said insertion magazine including a trigger unit with a trigger guard and a firing trigger, said firing trigger operably connected to a firing mechanism and affixed to the underside of the insertion magazine;

whereby the trigger unit can be removed from the small arm, together in connection with the insertion magazine.

17. The small arm according to claim 16, wherein the breech mechanism housing contains an opening, a lug, or an elevation, for locking the insertion magazine.

18. The insertion magazine according to claim 1, wherein said small arm is a repeating rifle.

19. A small arm, comprising:

a magazine well;

an insertion magazine, including an affixed trigger unit having a trigger guard and a trigger, said trigger unit affixed to the underside of the insertion magazine;

wherein the insertion magazine and said affixed trigger unit are concurrently releasably insertable into said magazine well without a requirement for the use of a tool.

20. The insertion magazine according to claim 19, wherein the insertion magazine is inserted into the magazine well at an angle with respect to a longitudinal axis of the barrel of the small arm.

* * * * *